US006098353A

United States Patent [19]

Stanfield

[11] Patent Number: 6,098,353

[45] Date of Patent: Aug. 8, 2000

[54] PROTECTIVE SLEEVE FOR A POST

[76] Inventor: Barney Stanfield, 5223 Bascule Ave., Woodland Hills, Calif. 91364

[21] Appl. No.: 09/098,012

[22] Filed: Jun. 15, 1998

[51] Int. Cl.[7] ..... E04L 3/30

[52] U.S. Cl. ..... 52/170; 52/169.13; 52/721.5; 52/723.2; 52/726.1; 52/736.4; 52/737.5

[58] Field of Search ..... 52/170, 721.4, 52/721.5, 723.1, 723.2, 726.1, 736.1, 736.3, 736.4, 737.4, 737.5, 738.1, 169.13, 298; 248/345.1

[56] References Cited

U.S. PATENT DOCUMENTS

| | | | |
|---|---|---|---|
| 1,409,155 | 3/1922 | Covan | 52/298 X |
| 1,982,569 | 11/1934 | Byrd | 52/736.4 X |
| 2,385,869 | 10/1945 | Lane | 52/170 X |
| 5,535,555 | 7/1996 | Boyd et al. | 52/726.1 X |
| 5,571,229 | 11/1996 | Fitzsimmons et al. | 52/736.4 X |
| 5,625,988 | 5/1997 | Killick | 52/298 |
| 5,632,464 | 5/1997 | Aberle | 52/298 X |
| 5,704,580 | 1/1998 | Peery, Jr. | 52/736.4 X |
| 5,832,675 | 11/1998 | Zuares | 52/170 X |
| 5,901,525 | 5/1999 | Doeringer et al. | 52/736.4 |

*Primary Examiner*—Beth A. Stephan
*Assistant Examiner*—Brian E. Glessner
*Attorney, Agent, or Firm*—Gene Scott-Patent Law & Venture Group

[57] ABSTRACT

A sleeve for the buried end of a fence or sign post provides a watertight construction having an enclosing side and bottom walls. A base portion encloses the post and a capping portion joins with the base portion, providing a water tight connection, the capping portion having a water tight sealing wall or a gasket for contact with the side surface of the post. An adaptor section may be fitted between the base and the capping portions in order to extend the length of the assembly for posts that are to be placed deeply into the ground or other footing.

6 Claims, 3 Drawing Sheets

PROTECTIVE SLEEVE FOR A POST

This application is based upon and presents similar disclosure as utility patent application Ser. No. 08/778,671 entitled "Protective And Stabilizing Sleeve For A Post," filed on Jan. 3, 1997 by the present inventor now abandoned.

BACKGROUND OF THE INVENTION

1. Field of the Invention

This invention relates generally to protective sleeves for in-ground fence or sign posts or the like, and more particularly to such a protective sleeve providing a means for excluding moisture from between the sleeve and the post.

2. Description of Related Art

The following art defines the present state of this field:

Fisher, U.S. Pat. No. 94,195 teaches a design for a post support, such design showing a box-like construction with a chisel lower edge and an open top for receiving a square post. Side fins extend from two opposing sides of the support.

Banks, U.S. Pat. No. 1,402,561 teaches post support providing a cylindrical receiver, chisel lower edge, disk shaped cap portion, and outwardly and downwardly extending stabilizing teeth.

Knowles, U.S. Pat. No. 5,082,231 teaches a post support for permanent installation at or below ground level including a post receiving collar affixed to fins. The fins have collar supporting shoulders against which a post may rest. A driver/cap/marker has a cap and sleeve with sleeve length the same as the collars length so that when the driver/cap/marker is inserted into the collar the lower edge of the sleeve rests on the shoulders and the underside of the cap/marker rests on top of the collar. The driver/cap/marker serves firstly as a tool for inserting the support into the ground and secondly as a cover for an unused support, and thirdly for marking the location of an unused collar.

Wells, U.S. Pat. No. 5,165,663 teaches a ground anchor for a post including an elongated vertically extending cylindrical PVC tube and including at the lower end of the tube an end member having a cylindrical portion snugly and frictionally fit within the tube and a conical portion projecting downwardly from the tube to a point, the end member having thereon within the tube an upwardly facing drive surface. An elongate driving member is removable insertable into the tube and has at one end a driving which is engageable with the free surface on the end member. In a variation, the tube has at the upper end a collar which includes an axially extending annular flange snugly fit within the upper end of the tube and a further annular flange projecting radially outwardly from the support end of the axial flange.

The prior art teaches certain means for protecting the bruied end of a post or beam. However, the prior art does not teach a fitted sleeve having means for extending the length of coverage of the protection and does not teach a monolithic capping means with an inclinded sidewall or peripheral gasket, adapted for intimate contact with the post. The present invention fulfills these needs and provides further related advantages as described in the following summary.

SUMMARY OF THE INVENTION

The present invention teaches certain benefits in construction and use which give rise to the objectives described below.

The present invention provides a post receiver having a closed end so that the received portion of the post is fully enclosed. A flange is positioned at the top, open end of the receiver and this flange includes a track for the insertion of a capping portion. The capping portion provides a flexible inclined wall or gasket that lays in intimate contact with the side surface of the post for excluding water from between the sleeve and the post.

An important aspect and objective of the present invention is the provision for a combination post and element excluding post receiver, having means for preventing water from entering the space between the receiver and the post.

Another object of the present invention is to provide a removable weather sealing means so that the strip may be replaced when necessary.

A further object of the present invention is to provide a weather sealing flap or gasket positioned so that it is biased to press against the side of the post for ensuring a tight weather-proof fit.

A still further object is to provide such a sealing means adaptable to extension in length in order to accommodate a post of greater buried depth.

A still further object is to provide a fastener means capable of drawing the invention tightly about the post so as to improve the ability of the device for excluding water flow.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
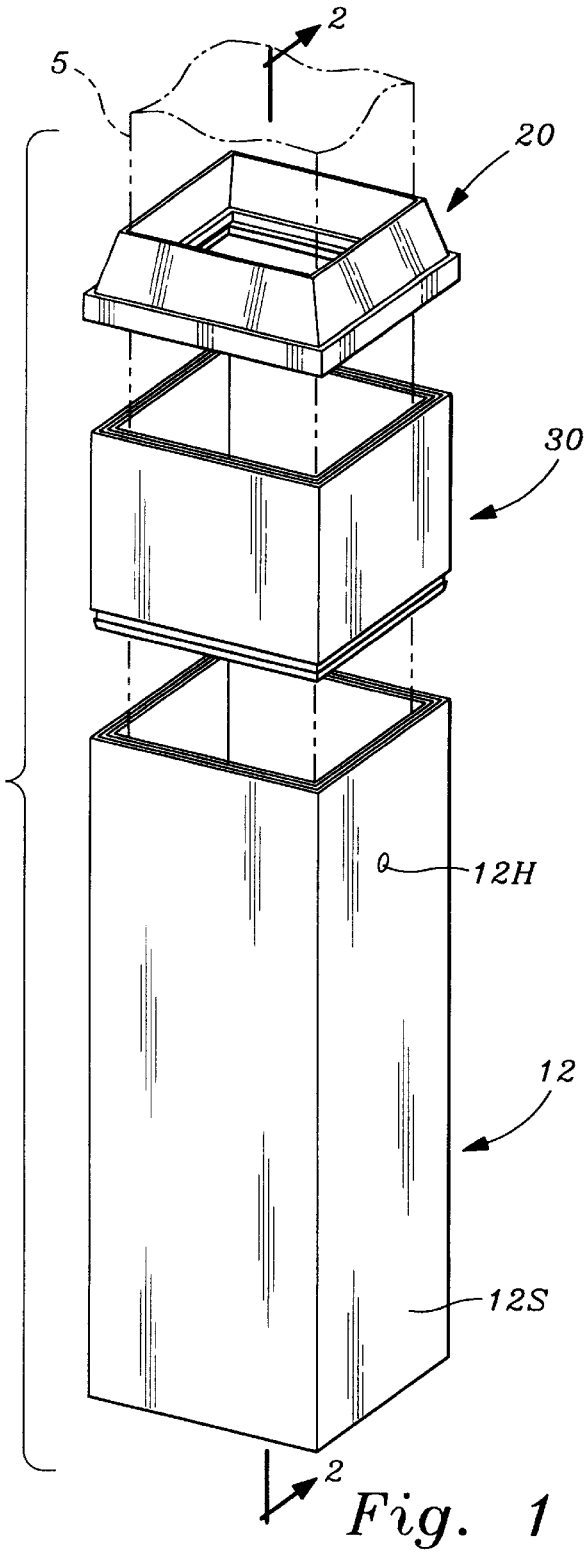
FIG. 1 is an exploded perspective view of a preferred embodiment of the invention showing a first capping portion of the invention.
Figure 2:
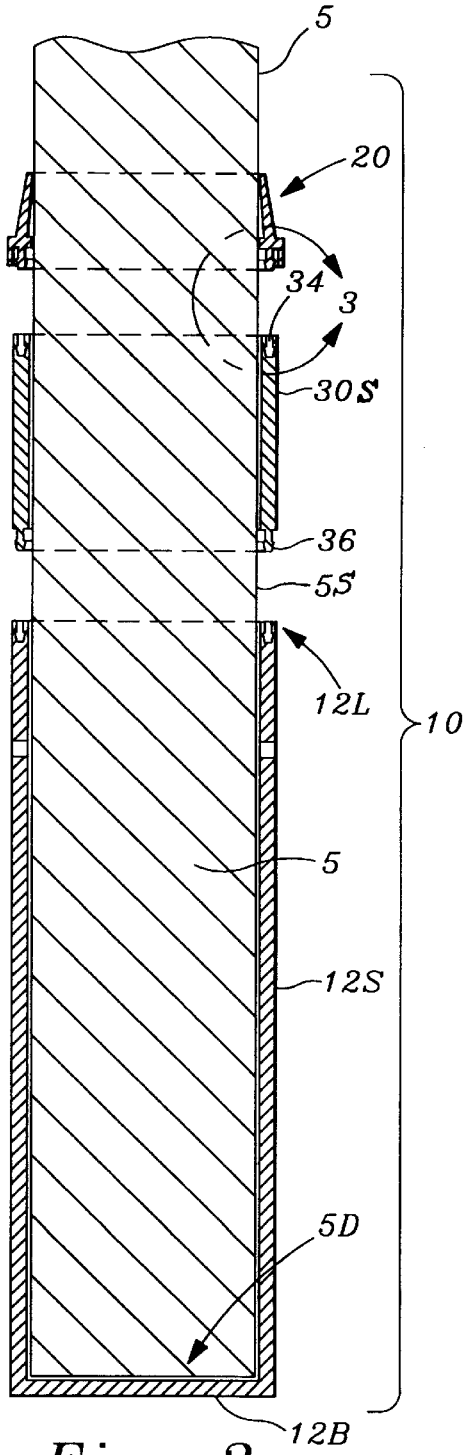
FIG. 2 is a side elevational section view thereof taken along line 2—2 in FIG. 1, and particularly showing a method of interconnection of the various portions of the instant invention.

Posts have been placed into ground holes and preserved by the use of asphalt, tar, creosote or other weather resistant formulations. When used, these materials are generally painted or otherwise placed onto the surfaces of the post that are to be placed underground. However, although posts are initially well protected by this means, this approach has several disadvantages. One disadvantage is that these materials become dry and brittle over time thereby rendering the post subject to the very elements they are designed to be protected from. Another disadvantage is the undesirable odor and messy appearance of such materials when applied liberally to post surfaces especially when within view. Finally, this approach provides no structural support to the post and no resistance to post tipping, rotating, or withdrawal.

The above described drawing figures illustrate the invention, a protective sleeve device for a post 5. The invention is a combination of post 5 and a protective sleeve means 10, comprising an elongate post 5 having a distal end 5D for engaging a ground surface for supporting the post 5 in an upright attitude for supporting a fence fabric or other common use, the post 5 having a post side wall surface 5S.

The sleeve means 10 preferably comprises, a cylindrical base portion 12 providing a base side wall 12S, the base side wall being closed at one end by an integral bottom wall 12B, the side wall and bottom wall being positioned over the distal end 5D of the post 5 and tightly fitted therearound, the base portion 12 being open at its other end, said other end exposing a base peripheral lip 12L, the base peripheral lip further providing a peripheral groove "G" therein; and a cylindrical capping portion 20, providing a capping band 22 for encircling the post 5, the capping band providing a peripheral capping tongue "T" extending therefrom and positioned for engaging the base groove "G" so as to form a water tight interconnection therewith, the capping portion 20 further providing a cylindrical, sealing wall 26 inclinded toward the post side wall 5S surface and in such intimate contact therewith as to prevent water from entering between the sealing wall 22 and the post side wall 5S. Alternately, the base portion 12 may incorporate the tongue "T" and the capping portion 20 incorporate the groove "G" as is clear from FIG. 5.

The invention may further include a cylindrical adaptor portion 30 providing an adaptor sidewall 30S with a pair of opposing adaptor peripheral lips 34 and 36 at alternate ends thereof, one of the adaptor peripheral lips providing the peripheral tongue "T" element and the other providing the groove "G" element so as to join the base portion 12 with the capping portion 20 in order to lengthen the assembly so that the post 5 may be buried more deeply.

The capping band 22 further may provide a peripheral wall portion 24 annularly external to the capping band 22 for intimate contact with the adaptor or base portions sidewall 12S or 30S, so as to further prevent water from entering between the tongue and groove construction. The base portion 12 may further include at least one hole 12H for accepting an antiturn device such as a spike or nail (not shown).

Figure 3:
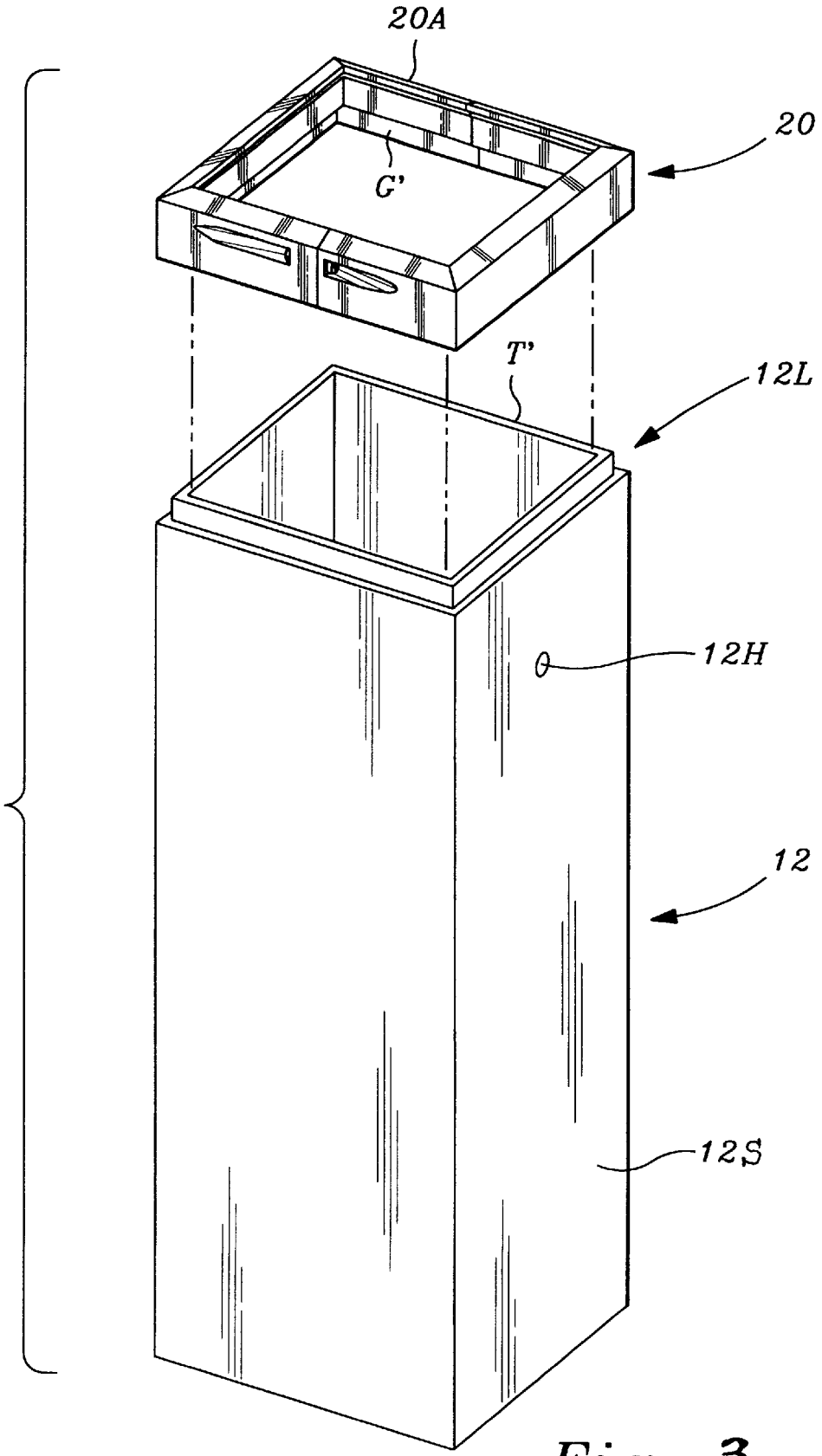
FIG. 3 is a exploded perspective view of a second embodiment of the invention showing a second capping portion of the invention.
Figure 5:
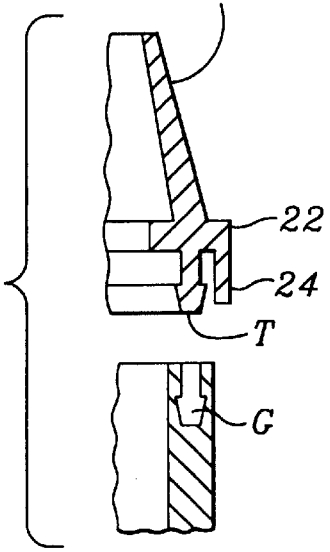
FIG. 5 is a sectional view taken along line 3—3 in FIG. 2.
Figure 4:
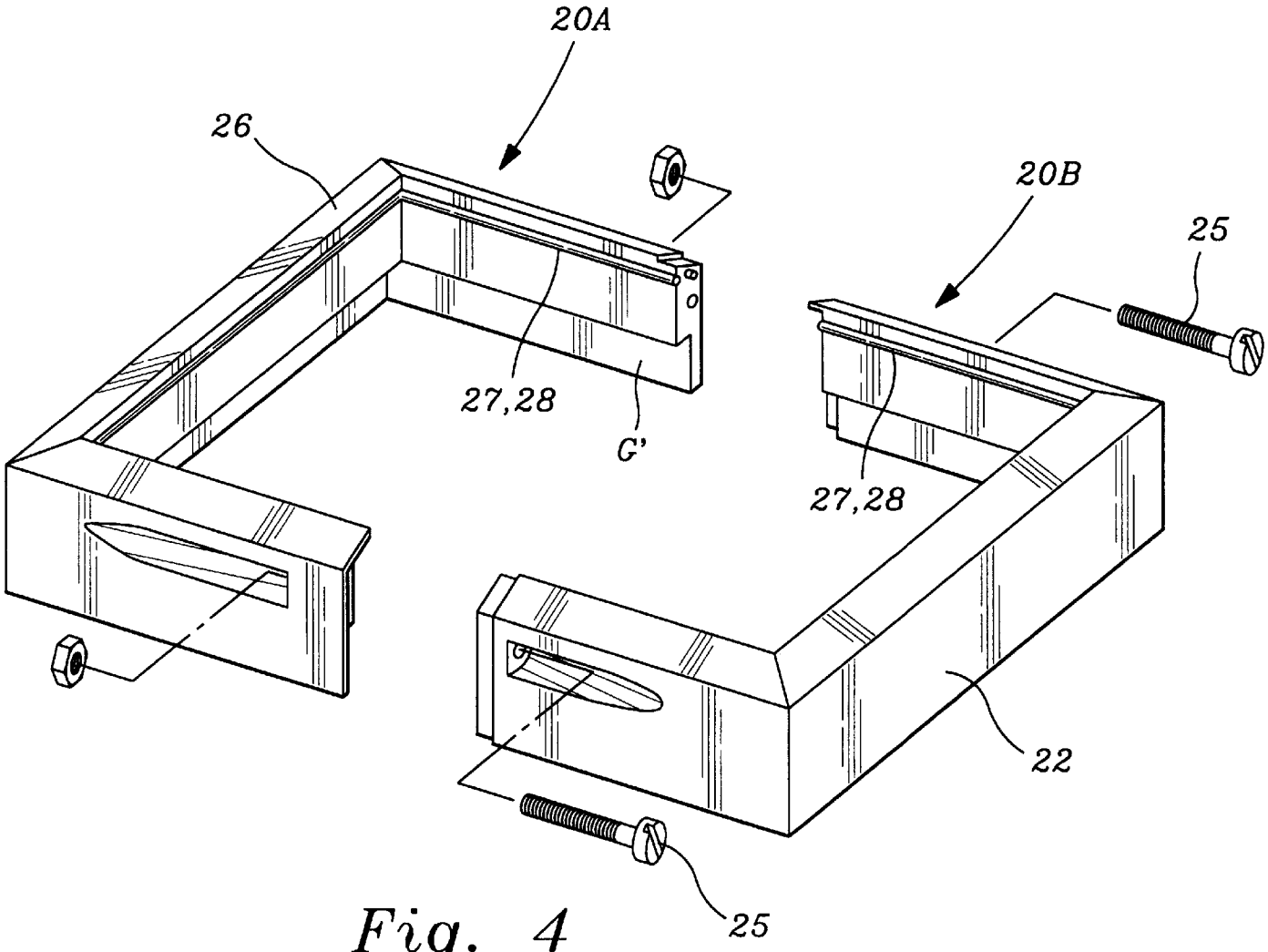
FIG. 4 is an enlarged view of the second capping portion.

In an alternate embodiment, shown in FIGS. 3 and 4, the capping portion 20 may be formed as two half-portions 20A and 20B, joned by a fastener means 25 such as screws with nuts, as shown in FIG. 5. In this manner the two half-portions may be drawn tightly around the post 5 to improve the tightness of fit. The capping band 22 may provide a peripheral capping groove 27 therein positioned for engaging a sealing gasket 28 protruding outwardly toward the post side wall surface 5S and in such intimate contact therewith as to prevent water from entering between the sealing gasket 28 and the post side wall 5S. In this embodiment, the sealing wall 26 may be discarded. The tongue T' and groove G', as shown in FIGS. 3 and 4 are configured so as to engage in an adjacency relationship, i.e., abutting, rather then an insertion relationship, i.e., tongue in groove.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. In combination, a post and a protective sleeve means, the combination comprising:

an elongate post having a distal end for engaging a ground surface for supporting the post in an upright attitude, the post having a post side wall surface;

a protective sleeve comprising:

i) a cylindrical base portion providing a base side wall, the base side wall being closed at one end by an integral bottom wall, the side wall and bottom wall being positioned over the distal end of the post and tightly fitted therearound, the side wall being open at an other end, said other end exposing a base peripheral lip, the base peripheral lip further providing a peripheral grooves the peripheral groove being fully contained within the base side wall, such that a portion of the base side wall forms each side of said peripheral groove;

ii) a cylindrical capping portion, providing a capping band for encircling the post, the capping band providing a peripheral capping tongue extending, therefrom and positioned for being fully engaged within the base groove so as to form a water tight interconnection therewith, the capping portion further providing a cylindrical, sealing wall inclined toward, and terminating at the post side wall surface and in such intimate contact therewith as to prevent water from entering between the sealing wall and the post side wall.

2. The device of claim 1 further including a cylindrical adapter portion providing an adapter sidewall with a pair of opposing adapter peripheral lips, one of the adapter peripheral lips providing an adapter peripheral tongue extending therefrom and positioned for tightly engaging the base portion peripheral groove for water tight interconnection therewith, the other of the adapter lips providing an adapter peripheral groove the peripheral groove being fully contained within the base side wall for tightly engaging the capping portion peripheral tongue, and adapted for being fully engaged within, for water tight interconnection therewith, the adapter functionally extending the overall length of the device.

3. The device of claim 2 wherein the capping band further provides a peripheral wall portion annularly external to the capping portion peripheral tongue and positioned for intimate contact with the adaptor sidewall.

4. The device of claim 1 wherein the capping band further provides a peripheral wall portion annularly external to the peripheral tongue and positioned for intimate contact with the base sidewall.

5. The device of claim 1 wherein the base portion provides at least one access hole for an antiturn device.

6. The device of claim 1 wherein the capping portion is formed as two half-portions joined by a fastener means.

* * * * *